US007213619B2

(12) United States Patent
Awad

(10) Patent No.: US 7,213,619 B2
(45) Date of Patent: May 8, 2007

(54) METHODS FOR REPLACING ENGINE SYSTEM COOLING FLUIDS WITH A CONTINUOUS FLOW

(75) Inventor: Adam Awad, Costa Mesa, CA (US)

(73) Assignee: Link New Tech, Inc., San Antonio, TX (US)

( * ) Notice: Subject to any disclaimer, the term of this patent is extended or adjusted under 35 U.S.C. 154(b) by 87 days.

(21) Appl. No.: 10/770,896

(22) Filed: Feb. 2, 2004

(65) Prior Publication Data

US 2005/0166991 A1 Aug. 4, 2005

(51) Int. Cl.
*B65B 31/00* (2006.01)

(52) U.S. Cl. ..... 141/5; 141/8; 141/65; 141/98; 165/95

(58) Field of Classification Search ..... 141/1–7, 141/59, 65, 67, 91, 92, 98, 11; 165/95; 184/1.5, 184/6.4, 108, 105.1; 134/169 C, 166 C, 134/169 A; 73/37, 40, 45.8, 49.2, 49.7
See application file for complete search history.

(56) References Cited

U.S. PATENT DOCUMENTS

| | | | | |
|---|---|---|---|---|
| 4,109,703 | A | 8/1978 | Babish et al. | 165/1 |
| 5,103,878 | A | 4/1992 | Cassia | 141/65 |
| 5,615,716 | A | 4/1997 | Akazawa | 141/91 |
| 5,649,574 | A | 7/1997 | Turcotte et al. | 141/67 |
| 5,845,684 | A | 12/1998 | Fletcher, Jr. et al. | 141/98 |
| 6,073,666 | A | 6/2000 | Clark, II | 141/83 |
| 6,213,175 | B1 | 4/2001 | Rome et al. | 141/98 |
| 6,234,215 | B1 | 5/2001 | Klamm | 141/1 |
| 6,523,580 | B1 | 2/2003 | Awad | 141/65 |
| 6,604,557 | B2 | 8/2003 | Awad | 141/65 |
| 6,637,472 | B2 * | 10/2003 | Camacho et al. | 141/98 |
| 2005/0067048 | A1 * | 3/2005 | Few | 141/98 |

* cited by examiner

*Primary Examiner*—Timothy L. Maust
(74) *Attorney, Agent, or Firm*—Gene Scott; Patent Law & Venture Group

(57) ABSTRACT

A method of replacing fluid in an automotive system requires interconnecting a radiator fill port of the radiator with a first external tank through a closed control valve, disconnecting an upper hose from an upper radiator port and reconnecting the upper hose to a second external tank containing a replacement fluid. The system is sealed so that fluids are constrained for movement only within and between the engine, radiator and external tanks through the various hoses. When a pressure differential is applied within the system, fluid is forced from the automotive system into the first external tank, while automatically refilling the automotive system with the replacement fluid from the second external tank.

2 Claims, 5 Drawing Sheets

METHODS FOR REPLACING ENGINE SYSTEM COOLING FLUIDS WITH A CONTINUOUS FLOW

BACKGROUND OF THE INVENTION

1. Incorporation by Reference

Applicant(s) hereby incorporate herein by reference, any and all U.S. patents and U.S. patent applications cited or referred to in this application.

2. Field of the Invention

This invention relates generally to methods for replacement of fluids in systems and more particularly the replacement of coolant fluids in an automotive type engine cooling system.

3. Description of Related Art

The following art defines the present state of this field:

Babish et al., U.S. Pat. No. 4,109,703 describes an internal combustion engine cooling system that is flushed by: (a) providing a controlled pressurized flow of flushing liquid and entrained gas bubbles, (b) and passing said flow alternately through (i) the radiator in a reverse direction, (ii) the engine coolant passages in a reverse direction, (iii) the radiator in a forward direction, (iv) the engine coolant passages in a forward direction.

Cassia, U.S. Pat. No. 5,103,878 describes a flush cap for a vehicle cooling system wherein the flush cap has an inlet through which fresh water enters and an outlet through which dirty coolant leaves. The method employs the flush cap to flush the cooling system of the vehicle. The radiator cap can be adapted to drain a radiator using a hose attached to the outlet of the cap.

Akazawa, U.S. Pat. No. 5,615,716 describes an engine coolant changing apparatus for changing an engine coolant such as LLC (long-life coolant) in an engine coolant path containing a radiator, comprising coolant storing means possessing a pressure action port and a liquid inlet and outlet, detaching mechanism to be attached or detached to or from a filler port of a radiator, communicating device for communicating between the liquid inlet and outlet and the detaching device, and pressure action device for applying a negative pressure to the pressure action port to overheat the coolant to a low temperature by driving an engine when discharging the coolant from an engine coolant system, and applying a positive pressure to the pressure action port when feeding a fresh liquid, so that the coolant can be changed promptly in a short time, without requiring manipulation of radiator drain cock or jack-up of the vehicle.

Turcotte et al., U.S. Pat. No. 5,649,574 describes a removal and refill apparatus for use in removing and/or refilling coolant in an automotive cooling system. The automotive cooling system typically includes a radiator, overflow bottle, engine, water pump, and heater core elements. A method for utilizing the coolant removal and refill apparatus utilizing vacuum and pressure is described for use with the removal and refill apparatus.

Fletcher, Jr. et al., U.S. Pat. No. 5,845,684 describes a clean and easy-to-use, portable upright apparatus, and a method for its use, which can be used to flush and fill the radiator and coolant systems of motorized vehicles in approximately 15 minutes, the apparatus comprising a self-priming pump, a waste collection tank, a tank for holding new or recycled coolant, a filter assembly, and a wheeled support structure for conveniently and efficiently housing the pump, tanks, filter assembly, and the several hoses needed to perform the flush and fill procedure. Applications may include, but are not limited to, flushing coolant from automobile radiators and refilling them with new or recycled coolant.

Clark, II, U.S. Pat. No. 6,073,666 describes a portable automated fluid collecting and dispensing unit (10) for the collection of used fluid and for the delivery of new fluid to a fluid utilizing device, such as motor (44). The device (10) includes a tank arrangement (12) having a used fluid tank (14) for collecting and storing used fluid and a new fluid tank (16) for storing and delivering new fluid. The new and used fluid tanks (14 and 16) are dedicated to contain only more particular fluid. A cart (16) carries the tank arrangement (12), and has load cells (26) for determining changes in weight of the tank arrangement (12) and any used fluid and new fluid contained therein. A display (58) indicates any said change in weight of said tank arrangement (12) and any fluid contained therein. The system can also include a stationary primary system (120) for use in recharging the portable device (10), without any intervening cleaning of the device.

Rome et al., U.S. Pat. No. 6,213,175 describes a method and apparatus, for servicing engine cooling systems, including a service inlet, a vacuum pump, a two-way solenoid interposed between the vacuum pump and the service inlet, a service outlet, a disposal hose, a new fluid tank, a pressure pump interposed between the service outlet and the new fluid tank, a three-way solenoid interposed between the service outlet and the two-way solenoid, a low-level trigger mechanism, a flow control relief valve and other elements to enhance various modes of operation. The apparatus is capable of performing various operations, including closed-loop fluid cycle, fluid vacuum, fluid top-off, fluid exchange and fluid flow control.

Klamm, U.S. Pat. No. 6,345,215 describes an apparatus for adding coolant to a cooling system of a motor vehicle including a cap with a resilient sleeve that expands against the inside wall of a radiator filler neck to provide an air-tight connection. A valve attached to the cap controls the flow of air and coolant through the cap. A gauge on the cap indicates the pressure inside the radiator. A venturi assembly connected to the valve provides a source of vacuum for evacuating air from the cooling system. Thereafter, coolant is drawn through the cap by the vacuum created in the system.

Awad, U.S. Pat. No. 6,523,580 describes an apparatus comprising a wheeled cart, and mounted on the wheeled cart a plurality of containers placed in adjacent upright attitudes. A support framework engages the wheeled cart and further provides a support framework engaging an operator's panel with operator's controls. A suction developing device, pressure developing device, conduit switching device, and conduit manifolding device, are enabled for acting together to apply vacuum and pressure exertion on fluids for driving such fluids between the containers and an automotive radiator through a system of conduits.

Awad, U.S. Pat. No. 6,604,557 describes a method of replacing radiator fluid in an automotive radiator including providing two gas tight containers, a fluid conducting hose with a gas tight nozzle fitted into a radiator fill pipe nipple. The method further includes the steps of filling one of the containers with a fresh radiator fluid, drawing a high vacuum on a second one of the containers, drawing spent radiator fluid into the second one of the containers using only suction from the container, thereby leaving the automotive radiator under a partial vacuum and then drawing the fresh radiator fluid, from the first one of the containers, into the radiator using only suction from the partial vacuum in the radiator. A radiator flush step may also be applied following the same method, using two additional containers, one with initial high vacuum and the other containing flush fluid.

Gayet, EP 1013908 describes a coolant fluid replacement device for an automobile, utilizing an open loop distribution circuit within the coolant loop during the replacement of the used coolant. The coolant loop comprises a radiator that includes an inlet from the engine and an outlet to the engine. During the coolant replacement process, the device is connected between the coolant pumps of the vehicle system. The new fluid is stored in a first reservoir. As the new fluid is pumped into the system, the old fluid is forced out into a second reservoir.

Our prior art search with abstracts described above teaches the use of pumps for providing the force necessary to move used fluids from automotive systems and to replace them with new fluids. However, the present invention in one embodiment uses a vacuum technique to enable fluids to be exchanged in a continuous process where used fluids are drained while new fluids are inserted into the system to replace the used fluids, and in a further embodiment, the fluids are exchanged using either internal or external pumps. The present invention provides further related advantages as described in the following summary.

SUMMARY OF THE INVENTION

The present invention teaches certain benefits in construction and use which give rise to the objectives described below.

Clearly, the prior art methods are complex, require expensive hardware systems, are subject to fluid spills and require considerable time and applied labor. The present invention is a method of replacing fluid in an automotive cooling system that overcomes all of these drawbacks by interconnecting a radiator fill port with a first external tank through a closed control valve, disconnecting an upper hose from an upper radiator port and reconnecting the upper hose to a second external tank containing a replacement fluid. The system produced by these interconnections is sealed with the exception of at least one of the external tanks, so that fluids are constrained for movement only within and between the engine, radiator and external tanks through the various hoses. When a pressure producing device is operated in the system, fluid is forced into and from the automotive system driving a used fluid out and replacing it with a new fluid, one of the external tanks receiving the used fluid, the other of the external tanks delivering the new fluid. This may be accomplished with or without the engine operating so that a vehicle that cannot be operated is still able to have its cooling fluid replaced.

A primary objective of the present invention is to provide a method that yields advantages not taught by the prior art.

Another objective is to provide such an invention capable of replacing engine coolant fluids in a single step process without operating the engine or its coolant pump.

A further objective is to provide such an invention capable of replacing engine coolant fluids by suction action.

A still further objective is to provide such an invention capable of replacing engine coolant fluids in a single step process using the engine coolant pump.

A still further objective is to provide such an invention capable of replacing engine coolant fluids in a single step process using an external pump.

A still further objective is to provide such an invention capable of replacing engine coolant fluids by providing a fluid pressure differential in a closed system.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1:
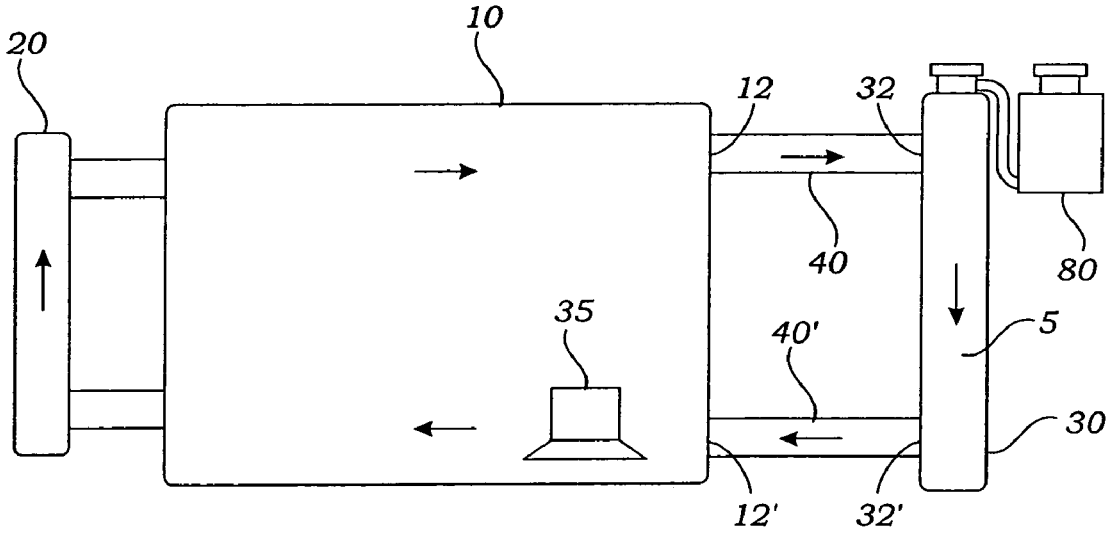
Prior Art Fig. 1
FIG. 1 is a schematic diagrams of a common prior art automotive engine cooling system.

The above described drawing figures illustrate the invention in two of its preferred embodiments, which is further defined in detail in the following description. Those having ordinary skill in the art may be able to make alterations and modifications in the present invention without departing from its spirit and scope. Therefore, it must be understood that the illustrated embodiments have been set forth only for the purposes of example and that they should not be taken as limiting the invention as defined in the following description.

The present invention is a method of fluid exchange particularly applicable to automotive engine cooling systems as well as other similar systems that use cooling fluids and require change-out of such fluids on a periodic basis. As shown in the schematic diagram of FIG. 1, the prior art teaches the well known automotive system having a motor or engine 10 engaged with an auxiliary heat exchanger 20 at the left, and a radiator 30 at the right wherein coolant fluid, referred to herein as "used fluid 5," and "new fluid 6" is mutually exchanged through a hose system including an upper hose 40 from an upper engine port 12 to an upper radiator port 32, a lower hose 40' from a lower radiator port 32' to a lower engine port 12'. The fluid 5 flows through the entire system including the auxiliary heat exchanger 20 as shown, driven by the engine's coolant pump 35 during normal engine operation.

Figure 2:
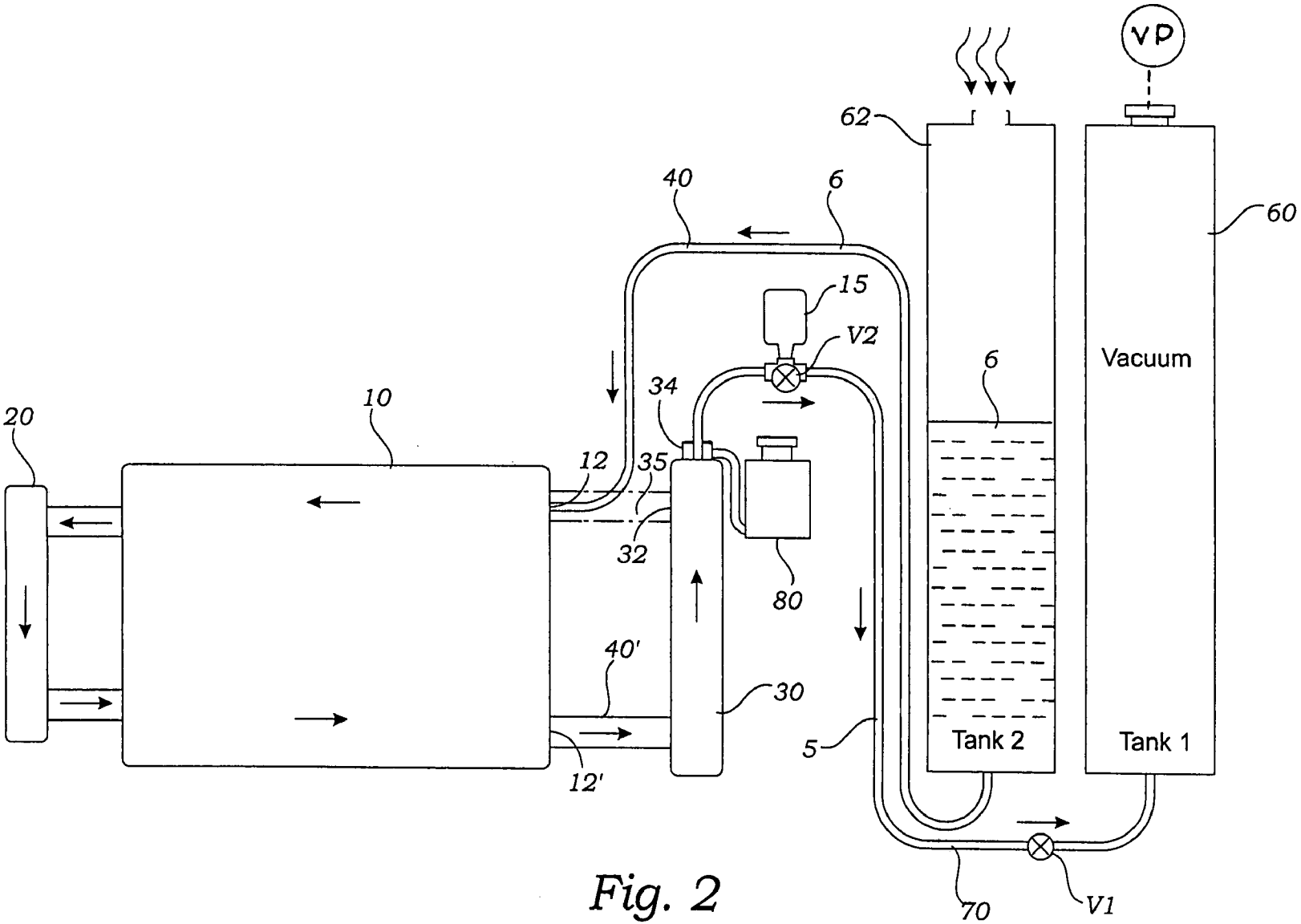
FIGS. 2 and 3 are schematic diagrams of a first embodiment of the present invention using overflow and expansion tanks respectively, and suction for driving a fluid exchange.

In a first embodiment of the present method, replacing the used fluid 5 in the system, as shown in FIG. 2, includes the step of interconnecting the radiator's fill port 34 with a first external tank 60 using a tank hose 70, which is not a part of the prior art system shown in FIG. 1. This tank hose 70 is connected through a closed control valve V1. A means for producing a pressure delta in the system is applied, in this embodiment, vacuum pump VP, so that a partial vacuum is drawn in the first external tank 60, and it should be noted that this tank is then closed so that its negative pressure is able to be held at steady state until starting the fluid exchange process. Vacuum pumps and air pressure driven vacuum venturi pumps are available at low cost and are used at most automotive service facilities, so that the use of vacuum in the present process does not present a problem. Next, the upper hose 40 is disconnected from the upper radiator port 32 and is then reconnected to a second external tank 62, through an extension hose if necessary, where the second external tank 62 contains the new fluid 6. Now, the entire system is sealed so that all fluids within the system are constrained to move only within and between the engine 10, with or without auxiliary heat exchanger 20, radiator 30 and the two external tanks 60 and 62 through the upper hose 40, lower hose 40', tank hose 70 and any extensions hoses as required. Of course external tank 62 is open to atmosphere so that new fluid 6 may be drained without producing a negative pressure in tank 62. The upper port 32 may easily be sealed with a rubber stopper and the radiator fill port 34 may be entered by a rubber stopper with a fluid conduit passed through, as is well known from common practice and chemistry laboratory technique. All other openings into the system are likewise closed off so that fluid cannot pass out of the system and air is not able to enter the system as well. In this state, the system is a closed system for purposes of fluid exchange.

When, as shown in FIG. 2, the control valve V1 is opened, suction from the first external tank 60 pulls the used fluid 5 from the system into the first external tank 60, while forcing the refilling of the system with the replacement fluid 6 from the second external tank 62. This process continues until all of the used fluid 5 is out of the automotive system and is replaced by the new fluid 6. The amount of used fluid 5 that is replaced is able to be controlled by simply setting the amount of new fluid that is initially placed into tank 62. Clearly, the control valve V1 can be closed once all of the new fluid 6 has been moved into the automotive system and if the amount of new fluid 6 is sufficient to fill the system, it can be assured that all of the used fluid 5 has been removed. The system may now be reconnected as it was originally, as shown in FIG. 1 for normal system operation.

In the case that the used fluid 5 is sufficiently dirty, the system may be cleaned prior to replacement of the used fluid 5. To accomplish this a partial vacuum is drawn on the automotive system, preferably through the radiator fill port 34, and then, with the engine running, valve V2 is opened so that a cleaning fluid in bottle 15 is sucked into the system through the radiator fill port 34 and circulated through the entire system. Of course, if the system is full, some used fluid 5 must be drained initially to make room for the cleaning fluid. After enough time has elapsed for the engine to be thoroughly cleaned, approximately five to ten minutes on average, the engine is shut down and the fluid exchange method described above may then be initiated.

After the used fluid 5 is replaced by the new fluid 6, a post step of again drawing a partial vacuum in the automotive system may be taken, and then with an engine conditioning agent in bottle 15 mounted at valve V2, this valve V2 may be opened to suck the conditioner into the system through the radiator fill port 34.

Figure 3:
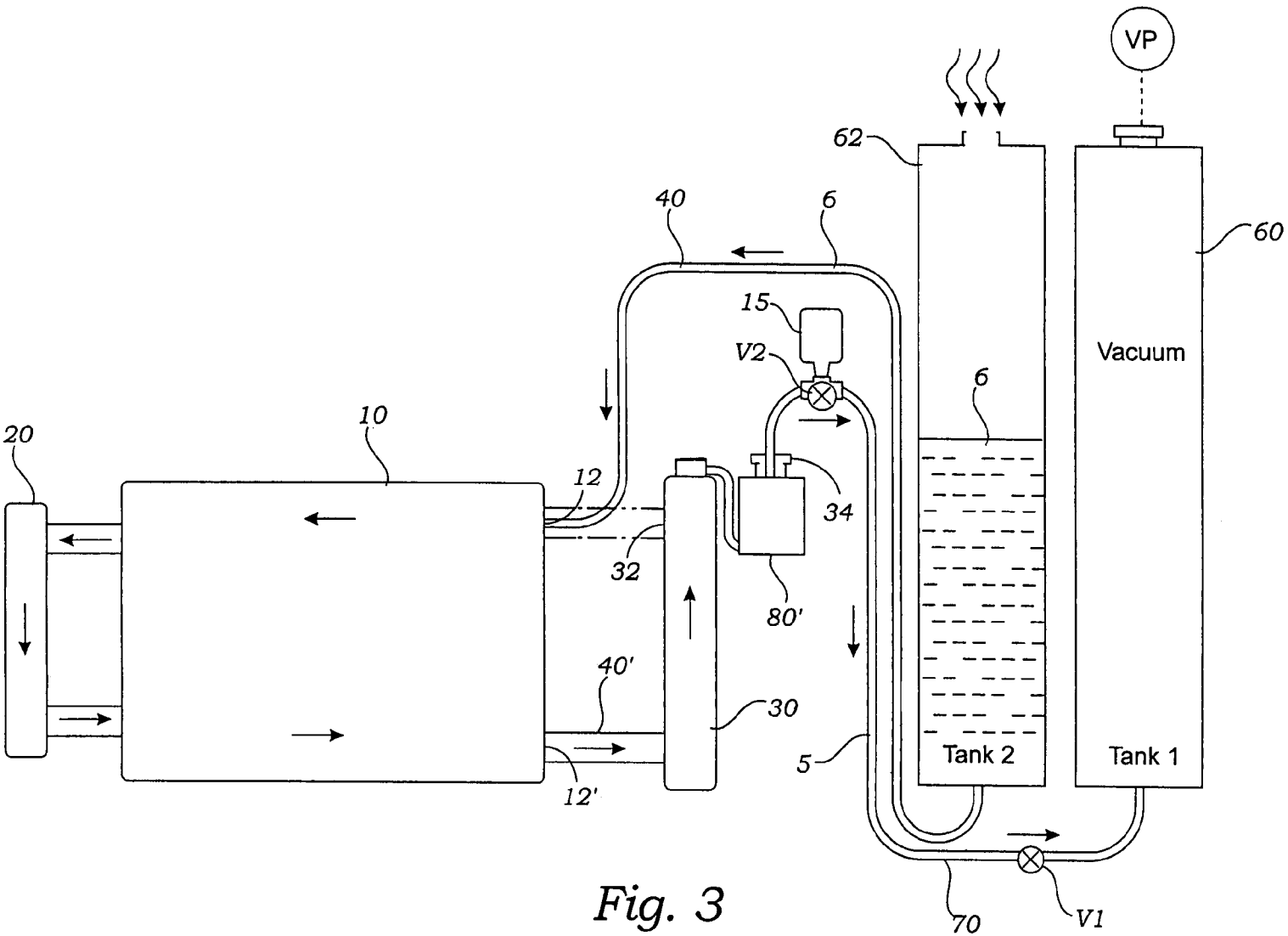

In the above description, referring to FIG. 2, the radiator 30 is shown fitted with an overflow tank 80 which is usually permanently mounted to it and serves to receive any overflow of coolant from the radiator 30. Such overflow is able to be sucked back into radiator 30 should the level in radiator 30 subsequently drop. The diagram of FIG. 3 is identical to that of FIG. 2 with the exception the radiator 30 does not provide fill port 34, but instead is connected to expansion tank 80', where expansion tank 80' is able to sustain a vacuum without caving in. In this case, expansion tank 80' provides fill port 34. For purposes of the present invention, the radiator 30 and the expansion tank 80' may be considered to be a single functional element where it matters little whether the radiator 30 or the expansion tank 80' receives the tank hose 70. In this case the port 34 is on the expansion tank 80' and fluid enters the radiator 30 through the expansion tank 80'. In this exposition, the use of the word "radiator" shall mean either the radiator alone, or the combination of the radiator 30 and the overflow tank 80.

Figure 4:
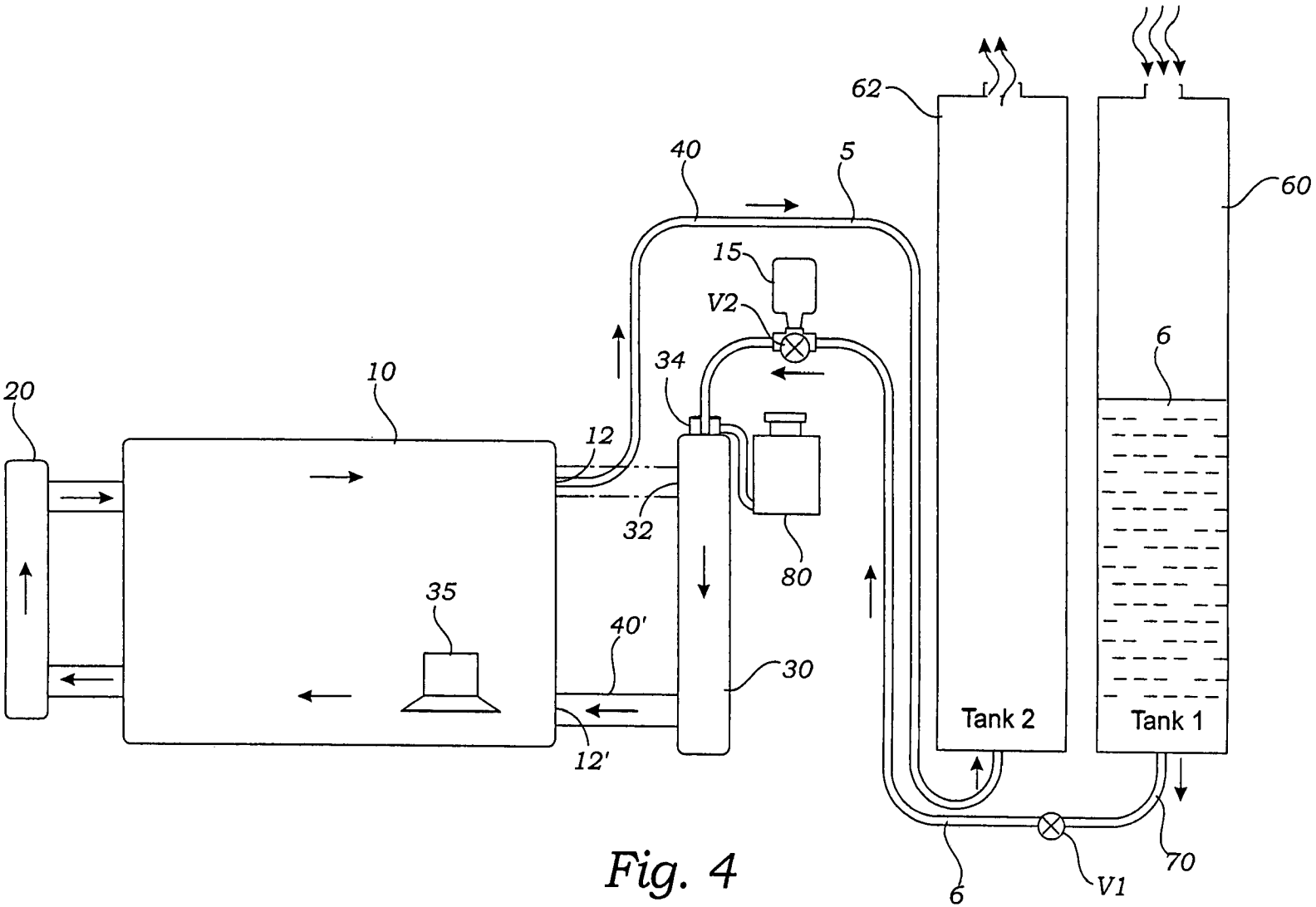
FIGS. 4 and 5 are schematic diagrams of a second embodiment of the present invention using overflow and expansion tanks respectively, and an internal fluid pump for driving a fluid exchange.
Figure 5:
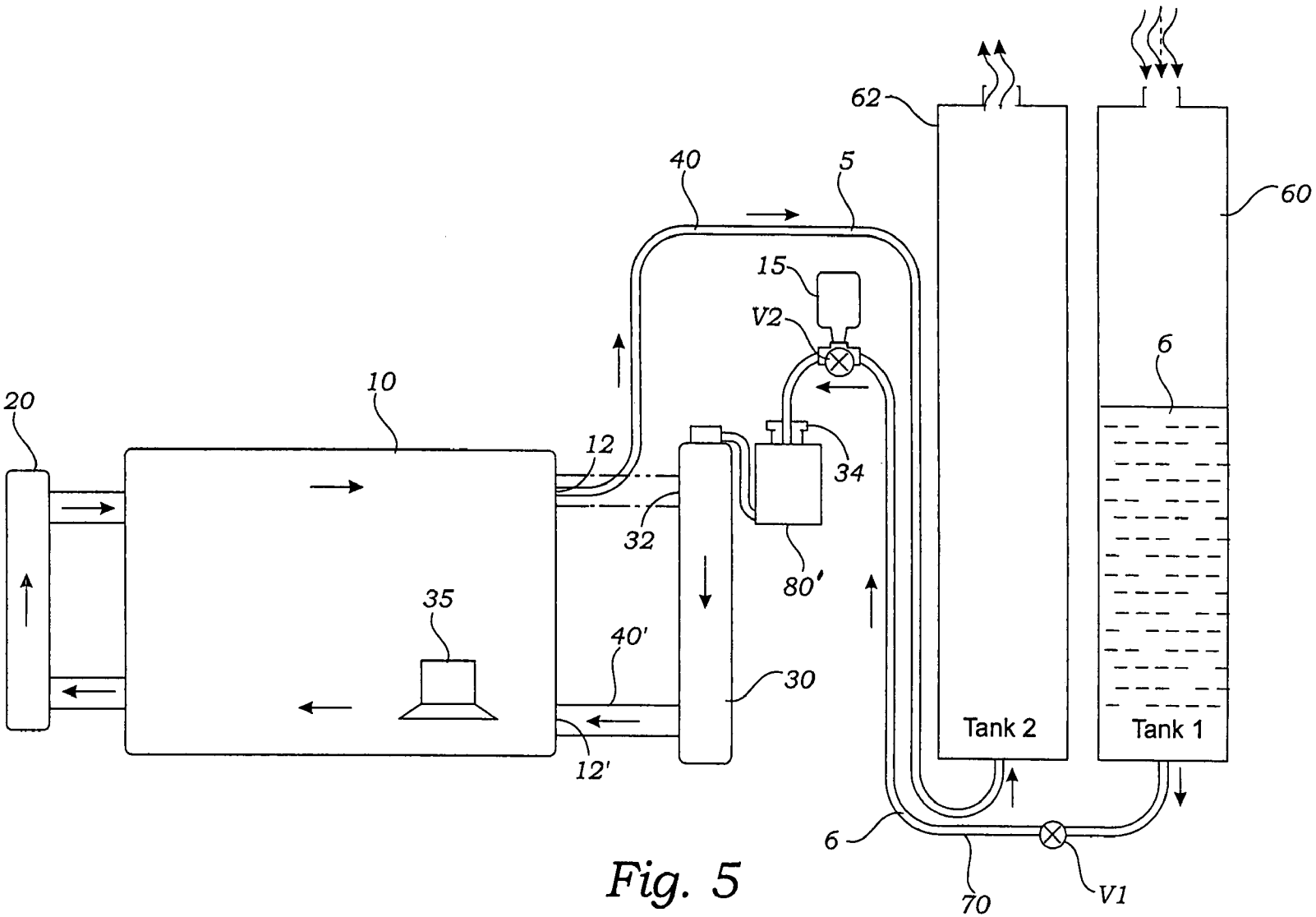

In a second embodiment of the present invention as shown in FIGS. 4 and 5, the fill port 34 is interconnected with the first external tank 60 which contains the replacement fluid 6 using the tank hose 70. Again the upper hose 40 from the upper radiator port 32 is disconnected from the radiator 30 and reconnecting to the second external tank 62. The system is sealed, as before, so that fluids within the system are constrained to movement only within and between the engine 10, radiator 30, and the external tanks 60, 62 through the upper hose 40, lower hose 40', tank hose 70 and possible extensions thereof. A means for producing a pressure delta in the system is applied, in this embodiment, the engine's coolant pump 35, so that suction is produced for drawing fluid from radiator 30 and thus from the first external tank 60. In this embodiment, the engine 10 is started to engage coolant pump 35 for circulating the used fluid 5 and thereby delivering it from the system into the second external tank 62, while refilling the system with the replacement fluid 6 from the first external tank 60. In this case, the tanks 60, 62 are both open to atmosphere to accommodate the loss and gain, respectively of fluids without changes in tank pressure. Again, as in the first embodiment, the expansion tank 80', as shown in FIG. 5, may be used to gain entry to the radiator 30 and the interconnection with the tank hose 70 is therefore from the expansion tank 80' to the first external tank 60 rather than directly with the radiator 30.

The enablements described in detail above are considered novel over the prior art of record and are considered critical to the operation of the instant invention and to the achievement of the above described objectives. The words used in this specification to describe the invention and its various embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or elements of this described invention and its various embodiments are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments below or that a single element may be substituted for two or more elements in a claim.

Changes from the claimed subject matter as viewed by a person with ordinary skill in the art, now known or later devised, are expressly contemplated as being equivalents within the scope of the invention and its various embodiments. Therefore, obvious substitutions now or later known to one with ordinary skill in the art are defined to be within the scope of the defined elements. The invention and its various embodiments are thus to be understood to include what is specifically illustrated and described above, what is conceptually equivalent, what can be obviously substituted, and also what essentially incorporates the essential idea of the invention.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. In an automotive cooling system containing a used coolant fluid and having an engine engaged with a radiator for mutual fluid exchange through an upper hose from an upper radiator port to an upper engine port and a lower hose from a lower engine port to a lower radiator port, a method of replacing the used coolant fluid in the system with a new coolant fluid comprising the steps of:

a) proceeding with the engine not operating and with the used coolant fluid in a cool state;

b) interconnecting the radiator with a sealed first external tank, through a closed shutoff valve, using a first external hose;

c) creating a vacuum in the first external tank using a means for creating a suction and then disconnecting the suction creating means from the first external tank, the first external tank being sealed thereby holding the vacuum at steady state therein;

d) interconnecting the upper engine port with a vented second external tank containing the new coolant fluid using a second external hose;

e) sealing the cooling system so that fluids are constrained to move only within and between the engine, radiator, first external tank, second external tank, upper hose, upper radiator port, upper engine port, lower hose, shutoff valve, lower engine port and lower radiator port, and air is unable to enter the system;

f) opening the closed shutoff valve; and g) sucking the used coolant fluid from the automotive cooling system into the first external tank, and thereby simultaneously forcing the new coolant fluid to flow from the second external tank into the automotive cooling system through the second external hose.

2. The method of claim 1 further comprising the steps of: placing a selected amount of new fluid initially in the second external tank; and closing the shutoff control valve when all of the new fluid is in the engine; whereby the amount of used fluid removed from the engine is equal to the selected amount of new fluid initially placed into the second external tank.

* * * * *